US011199791B2

(12) United States Patent
Park et al.

(10) Patent No.: US 11,199,791 B2
(45) Date of Patent: Dec. 14, 2021

(54) STRUCTURE TO SELECTIVELY EXPOSE GRIP PORTION OF TONER CARTRIDGE

(71) Applicant: HEWLETT-PACKARD DEVELOPMENT COMPANY, L.P., Spring, TX (US)

(72) Inventors: Jinsam Park, Suwon-si (KR); Jin-Hong Kim, Suwon-si (KR); Seongwoong Yang, Suwon-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/263,628

(22) PCT Filed: Jul. 25, 2019

(86) PCT No.: PCT/US2019/043452
§ 371 (c)(1),
(2) Date: Jan. 27, 2021

(87) PCT Pub. No.: WO2020/185249
PCT Pub. Date: Sep. 17, 2020

(65) Prior Publication Data

US 2021/0286291 A1 Sep. 16, 2021

(30) Foreign Application Priority Data

Mar. 8, 2019 (KR) ..... 10-2019-0026609

(51) Int. Cl.
*G03G 21/18* (2006.01)
*G03G 15/08* (2006.01)
*G03G 21/16* (2006.01)

(52) U.S. Cl.
CPC ..... *G03G 15/0875* (2013.01); *G03G 21/1676* (2013.01); *G03G 21/1864* (2013.01); *G03G 21/1604* (2013.01); *G03G 2221/1846* (2013.01)

(58) Field of Classification Search
CPC ..... G03G 15/0875; G03G 21/1604; G03G 21/1846; G03G 21/1633; G03G 21/1676; G03G 21/1623; G03G 2221/1846
See application file for complete search history.

(56) References Cited

U.S. PATENT DOCUMENTS 4,803,521 A 2/1989 Honda
4,945,364 A * 7/1990 Maruyama ..... G03G 21/1832 347/138

(Continued)

FOREIGN PATENT DOCUMENTS

CA 2956560 A1 2/2016
EP 0586042 B1 3/1994

(Continued)

*Primary Examiner* — Walter L Lindsay, Jr.
*Assistant Examiner* — Laura Roth
(74) *Attorney, Agent, or Firm* — Trop Pruner & Hu, P.C.

(57) ABSTRACT

A toner cartridge includes a body accommodating toner, a front cover located in front of the body and provided with a first opening forming a grip portion for pulling the toner cartridge forward, an opening/closing member which is located inside the front cover and is switched to a first position closing the first opening and a second position opening the first opening, and an elastic member configured to apply an elastic force to the opening/closing member in a direction to be located at the second position.

15 Claims, 12 Drawing Sheets

(56) References Cited

U.S. PATENT DOCUMENTS

| | | | | |
|---|---|---|---|---|
| 6,169,865 | B1 | 1/2001 | Miyabe | |
| 7,302,213 | B2 | 11/2007 | Kimura et al. | |
| 7,715,755 | B2 | 5/2010 | Shiraki | |
| 8,121,516 | B2 | 2/2012 | Wu et al. | |
| 2004/0126134 | A1* | 7/2004 | Harada | G03G 21/1832 399/114 |
| 2007/0147884 | A1* | 6/2007 | Tanaka | G03G 21/185 399/111 |
| 2010/0158575 | A1* | 6/2010 | Maeshima | G03G 15/0868 399/262 |
| 2010/0215395 | A1* | 8/2010 | Funada | G03G 21/1846 399/110 |
| 2014/0140735 | A1* | 5/2014 | Oda | G03G 15/0875 399/258 |
| 2016/0357126 | A1* | 12/2016 | Kim | G03G 15/0886 |
| 2021/0240127 | A1* | 8/2021 | Park | G03G 21/1623 |

FOREIGN PATENT DOCUMENTS

| | | | | |
|---|---|---|---|---|
| EP | 2023212 | | 2/2009 | |
| EP | 2919074 | A1 * | 9/2015 | G03G 21/1885 |
| EP | 2088477 | B1 | 8/2016 | |
| JP | 2005258024 | | 9/2005 | |
| RU | 2383442 | C1 | 3/2010 | |
| RU | 2627944 | C2 | 8/2017 | |

* cited by examiner

STRUCTURE TO SELECTIVELY EXPOSE GRIP PORTION OF TONER CARTRIDGE

BACKGROUND

An image forming apparatus using an electrophotographic method is a printer that supplies toner to an electrostatic latent image formed on a photoreceptor to form a visible toner image on the photoreceptor, transfers the toner image to a printing medium via an intermediate transfer medium or directly to a printing medium, and then fixes the transferred toner image on the printing medium.

The toner is a consumable developer. For example, the image forming apparatus employs a structure capable of replenishing the developer. For example, the developer may be accommodated in a toner cartridge, and the toner cartridge may be removably mounted on a main body of the image forming apparatus. When the developer accommodated in the toner cartridge is exhausted, the toner cartridge is removed from the main body of the image forming apparatus and a new toner cartridge may be mounted on the main body of the image forming apparatus.

BRIEF DESCRIPTION OF THE DRAWINGS

FIGS. 6 and 7 are cross-sectional views of an example of a structure for switching an opening/closing member from a second position to a first position by an operation of mounting the toner cartridge of the example shown in FIG. 3 to a main body, wherein FIG. 6 shows a state before the toner cartridge reaches the mounting position, and FIG. 7 shows a state in which the toner cartridge reaches the mounting position;

FIGS. 9 and 10 are sectional views of an example of a toner cartridge, wherein FIG. 9 shows a state in which the toner cartridge is located at a mounting position, and FIG. 10 shows a state in which the toner cartridge is located at a projected position; and FIGS. 11 and 12 are sectional views of an example of a toner cartridge, wherein FIG. 11 shows a state in which the toner cartridge is located at a mounting position, and FIG. 12 shows a state in which the toner cartridge is located at a projected position.

DETAILED DESCRIPTION

Figure 1:
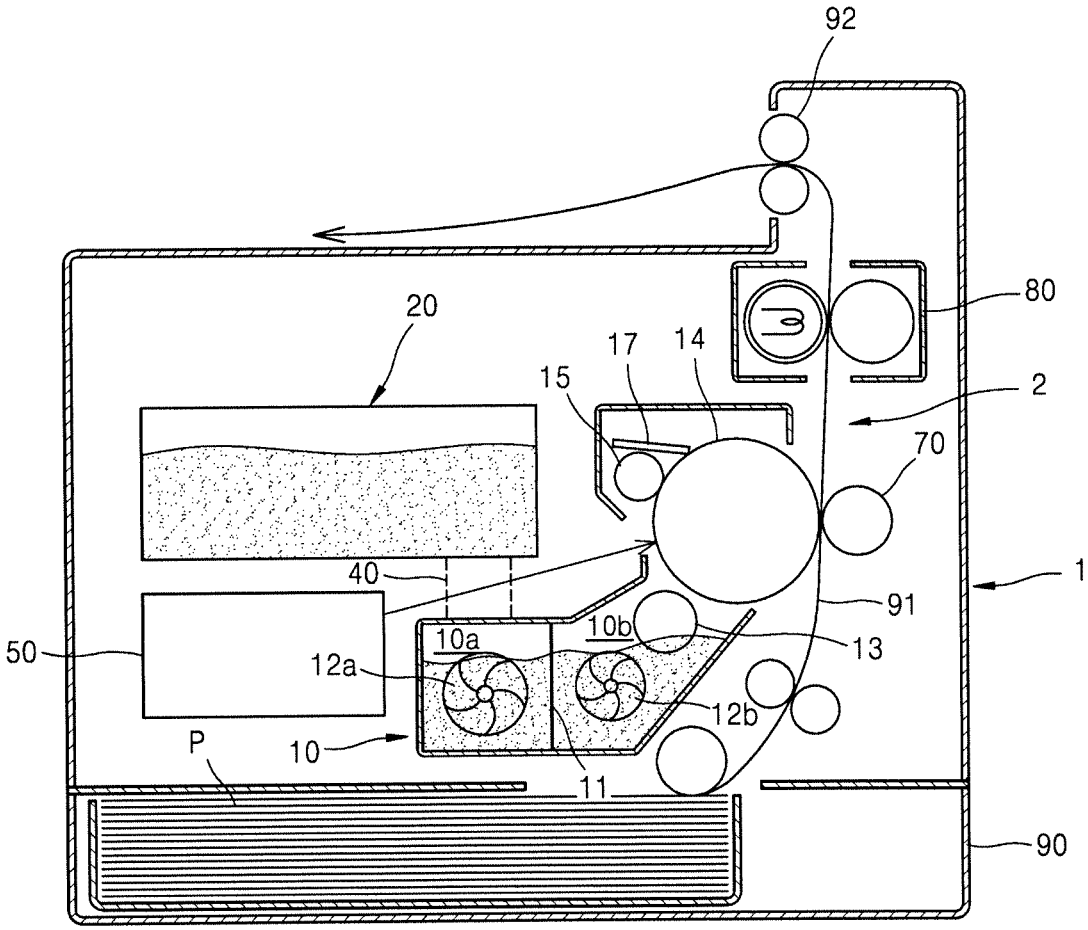
FIG. 1 is a configuration diagram of an example of an electrophotographic image forming apparatus.

FIG. 1 is a configuration diagram of an example of an electrophotographic image forming apparatus. Referring to FIG. 1, the electrophotographic image forming apparatus includes a main body 1 of the electrophotographic image forming apparatus and a toner cartridge 20 which is removably mounted on the main body 1. The toner cartridge 20 is also referred to as a 'toner cartridge'. The main body 1 of the electrophotographic image forming apparatus includes a printing unit 2 for printing an image on a printing medium P by an electrophotographic method. The printing unit 2 of the example prints an image on the printing medium P by the electrophotographic method. The printing unit 2 may include a developing unit 10, an exposure unit 50, a transfer unit, and a fixing unit 80.

The image forming apparatus may include the toner cartridge 20 containing a developer. The toner cartridge 20 accommodates the developer to be supplied to the printing unit 2. The toner cartridge 20 is mounted on the main body 1 and connected to the developing unit 10 and the developer accommodated in the toner cartridge 20 is supplied to the developing unit 10. The toner cartridge 20 may be connected to, for example, the developing unit 10 via a supply duct 40. Although not shown in the drawings, a supply unit for regulating a supply amount of the developer may be interposed between the toner cartridge 20 and the developing unit 10. Although not shown in the drawings, the toner cartridge 20 may have a carrying member for carrying a developer contained therein to the supply duct 40. The carrying member may be connected to a driving motor (not shown) provided in the main body 1 when the toner cartridge 20 is mounted on the main body 1.

The developing unit 10 supplies toner to an electrostatic latent image formed on a photosensitive drum 14 to develop the electrostatic latent image into a visible toner image. The developing unit 10 may include the photosensitive drum 14 to which the electrostatic latent image is formed and a developing roller 13 for supplying toner to the electrostatic latent image to develop the electrostatic latent image into a visible toner image. The photosensitive drum 14 is an example of a photoreceptor, and may include a conductive metal pipe and a photosensitive layer formed on the periphery thereof. A charging roller 15 is an example of a charger that charges the photosensitive drum 14 to have a uniform surface electric potential. Instead of the charging roller 15, a charging brush, a corona charger, or the like may be employed. Although not shown in the drawings, the developing unit 10 may further include a charging roller cleaner (not shown) for removing foreign materials such as a developer or dust adhered to the charging roller 15, a cleaning member 17 for removing a developer remaining on a surface of the photosensitive drum 14 after a transfer process described later below, and a regulating member (not shown) for regulating the amount of a developer supplied to a developing area where the photosensitive drum 14 and the developing roller 13 face each other. The cleaning member 17 may be, for example, a cleaning blade that contacts a surface of the photosensitive drum 14 to scrape a developer. Although not shown in the drawings, the cleaning member 17 may be a cleaning brush that contacts a surface of the photosensitive drum 14 while rotating and scrapes a developer.

A one-component development system using toner as a developer may be classified into a contact development system in which the developing roller 13 and the photosensitive drum 14 are rotated in contact with each other and a non-contact development system in which the developing roller 13 and the photosensitive drum 14 are rotated and located so as to be spaced apart from each other by tens to hundreds of microns.

In the case of a two-component development system using toner and a carrier as a developer, the developing roller 13 is located so as to be spaced apart from the photosensitive drum 14 by tens to hundreds of micrometers. Although not shown in the drawings, the developing roller 13 may include a hollow cylindrical sleeve to be rotated and a magnetic roller fixedly arranged inside the sleeve. The toner is attached to a surface of the magnetic carrier. The magnetic carrier is attached to a surface of the developing roller 13 and carried to a developing area where the photosensitive drum 14 and the developing roller 13 face each other. The toner is supplied to the photosensitive drum 14 by a developing bias voltage applied between the developing roller 13 and the photosensitive drum 14 to develop an electrostatic latent image formed on a surface of the photosensitive drum 14 into a visible toner image.

In the example, the two-component development system is employed. The inside of the developing unit 10 may be divided into a stirring chamber 10*a* and a developing chamber 10*b* by a barrier wall 11. A developer supplied from the toner cartridge 20 may be flow into, for example, the stirring chamber 10*a*. A stirrer 12*a* axially carries a developer inside the stirring chamber 10*a*. A stirrer 12*b* carries a developer inside the developing chamber 10*b* in a direction opposite the conveying direction of the stirrer 12*a*. The pair of stirrers 12*a* and 12*b* may be implemented, for example, by an auger. Openings for communicating the stirring chamber 10*a* and the developing chamber 10*b* with each other are provided on both sides of the barrier wall 11 in an axial direction, respectively. As a result, the developer is circulated inside the stirring chambers 10*a* and 10*b* by the pair of stirrers 12*a* and 12*b*. While the developer is carried by the stirrers 12*a* and 12*b*, toner is electrically charged by friction with a carrier. The developing roller 13 supplies toner inside the developing chamber 10*b* to the photosensitive drum 14 to develop an electrostatic latent image formed on the surface of the photosensitive drum 14 into a visible toner image.

In a case of the one-component development system, the toner cartridge 20 accommodates toner as a developer. In a case of the two-component development system, toner may be accommodated in the toner cartridge 20, or toner and a carrier may be accommodated. When a trickle development system is employed, toner and a carrier may be accommodated in the toner cartridge 20.

The exposure unit 50 irradiates light modulated corresponding to image information onto the photosensitive drum 14 to form an electrostatic latent image on the photosensitive drum 14. Examples of the exposure unit 50 include a laser scanning unit (LSU) using a laser diode as a light source or a light emitting diode (LED) exposure unit using an LED as a light source.

The transfer unit transfers a toner image formed on the photosensitive drum 14 to the printing medium P. The transfer unit may include a transfer roller 70. The transfer roller 70 is located facing the photosensitive drum 14. A transfer bias voltage for transferring the toner image formed on the photosensitive drum 14 to the printing medium P is applied to the transfer roller 70.

The fixing unit 80 applies heat and/or pressure to the toner image transferred to the printing medium P to fix the toner image on the printing medium P. A configuration of the fixing unit 80 is not limited to the example shown in FIG. 1.

According to the above configuration, the exposure unit 50 scans the photosensitive drum 14 with light modulated corresponding to image information to be printed, thereby forming an electrostatic latent image on the photosensitive drum 14. The electrostatic latent image on the photosensitive drum 14 is developed into a visible toner image by the developer supplied from the toner cartridge 20 to the developing unit 10. The printing medium P mounted on a paper feeding device 90 is carried between the transfer roller 70 and the photosensitive drum 14 along a paper feeding path 91. The toner image on the photosensitive drum 14 is transferred to the printing medium P by a transfer bias voltage applied to the transfer roller 70. When the printing medium P passes the fixing unit 80, the toner image is fixed to the printing medium P by heat and pressure. The printing medium P to which the toner image is fixed is discharged by a discharge roller 92.

The toner cartridge 20 is removably mounted on the main body 1. When the developer accommodated in the toner cartridge 20 is exhausted, the toner cartridge 20 may be replaced with a new toner cartridge 20.

Figure 2:
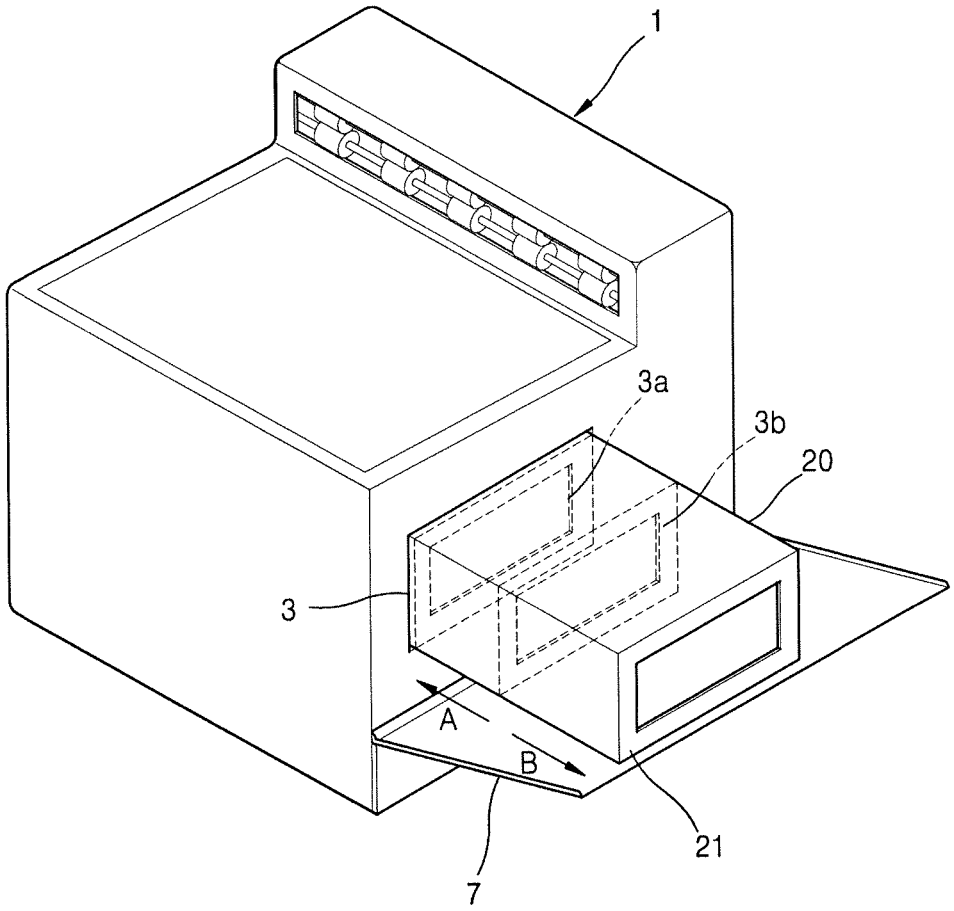
FIG. 2 is a perspective view of an example of an electrophotographic image forming apparatus showing mounting/removal of a toner cartridge.

FIG. 2 is a perspective view of an example of an image forming apparatus. Referring to FIG. 2, the main body 1 of the image forming apparatus may be provided with a mounting portion 3 on which the toner cartridge 20 is mounted. A door 7 opens and closes a portion of the main body 1 to mount/remove the toner cartridge 20 to/from the main body 1. As shown in FIG. 2, the mounting portion 3 is exposed when the door 7 is in an open position and the toner cartridge 20 may be slid in a mounting direction A and mounted on the mounting portion 3. When the mounting is completed, the toner cartridge 20 reaches a mounting position 3*a*.

A process of removing the toner cartridge 20 from the main body 1 may include a process of moving the toner cartridge 20 partially to the projected position 3*b* slightly out of the mounting portion 3. The toner cartridge 20 may be moved to a projected position 3*b* slightly moved in a removal direction B from the mounting position 3*a* by a removal member 6 (of FIG. 7) described later below. For example, the removal member 6 pushes the toner cartridge 20 located at the mounting position 3*a* to move the same from the mounting position 3*a* to the projected position 3*b*. In this state, the toner cartridge 20 may be pulled in the removal direction B and removed from the main body 1.

A portion of the toner cartridge 20 opposed to the door 7, for example, a front portion 21, does not have a concave or convex shape such that a user may grip and pull the toner cartridge 20 in the removal direction B. Therefore, a user cannot remove the toner cartridge 20 arbitrarily in a state in which the toner cartridge 20 is located at the mounting position 3*a*.

In order to remove the toner cartridge 20 from the mounting portion 3, it is necessary to move the toner cartridge 20 to the projected position 3*b*. For example, when a remaining amount of the developer in the toner cartridge 20 reaches a remaining amount as a replacement reference, it is possible to output a replacement signal that a user can perceive to replace the toner cartridge 20 through an output device (not shown) such as a display, a buzzer, a lighting device, or the like. The replacement signal may be, for example, a video signal displayed on a display, a sound signal through a buzzer, an optical signal through a lighting device, or the like. A user may input an operation for requesting replacement of the toner cartridge 20 via an operation panel. A control unit (not shown) may guide a user's operation procedure for replacing the toner cartridge 20, for example, via a display, and a user may replace the toner cartridge 20 in accordance with the guide. In order to prevent an arbitrary replacement of the toner cartridge 20, the operation procedure may include a password input. The control unit may operate the removal member 6 to push the toner cartridge 20 to the projected position 3*b* in the removal direction B in accordance with the user's operation. Accordingly, the front portion 21 of the toner cartridge 20, which faces the door 7, protrudes slightly from the mounting portion 3 and becomes in a removable state. At the mounting position 3*a*, the toner cartridge 20 may be locked to the main body 1 so that a user cannot arbitrarily remove the toner cartridge 20. The locking of the toner cartridge 20 to the main body 1 may be released as the toner cartridge 20 is moved from the mounting position 3*a* to the projected position 3*b* by the removal member 6.

The toner cartridge 20 located at the projected position 3*b* may be pulled in the removal direction B and removed from the mounting portion 3. As described above, the front portion 21 of the toner cartridge 20 opposed to the door 7 does not have a concave or convex shape such that a user may grip and pull the toner cartridge 20 in the removal direction B. Therefore, it is not easy to pull out the toner cartridge 20 located at the projected position 3*b* in the removal direction B. Since the amount of projection of the toner cartridge 20 at the projected position 3*b* is not so great, it is also difficult for a user to grip a projecting portion of the toner cartridge 20. A method may be considered in which the amount of projection of the toner cartridge 20 located at the projected position 3*b* from the mounting portion 3 is increased so that a user may grip the projecting portion of the toner cartridge 20. However, in this case, the size of the removal member 6 becomes greater, and the structure of the removal member 6 may be complicated.

The example provides the toner cartridge 20 employing a structure capable of selectively exposing a grip portion for removal. For example, the grip portion may be in a hidden state when the toner cartridge 20 is located at the mounting position 3*a* and may be exposed so that a user may grip the grip portion by hand when the toner cartridge 20 is moved from the mounting position 3*a* to the projected position 3*b*. Hereinafter, examples of the toner cartridge 20 employing the structure capable of selectively exposing the grip portion for removal will be described.

Figure 3:
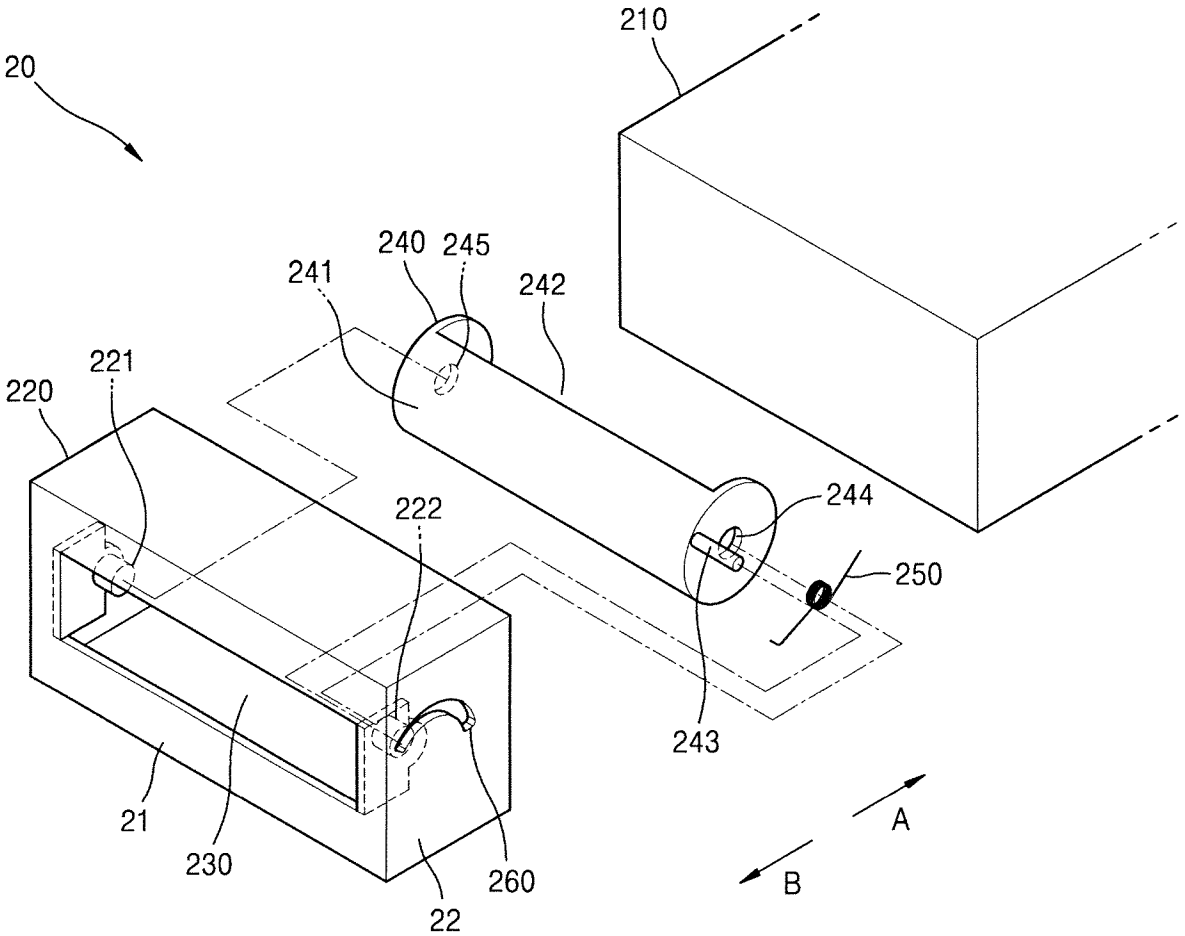
FIG. 3 is a partially exploded perspective view of an example of a toner cartridge.
Figure 4:
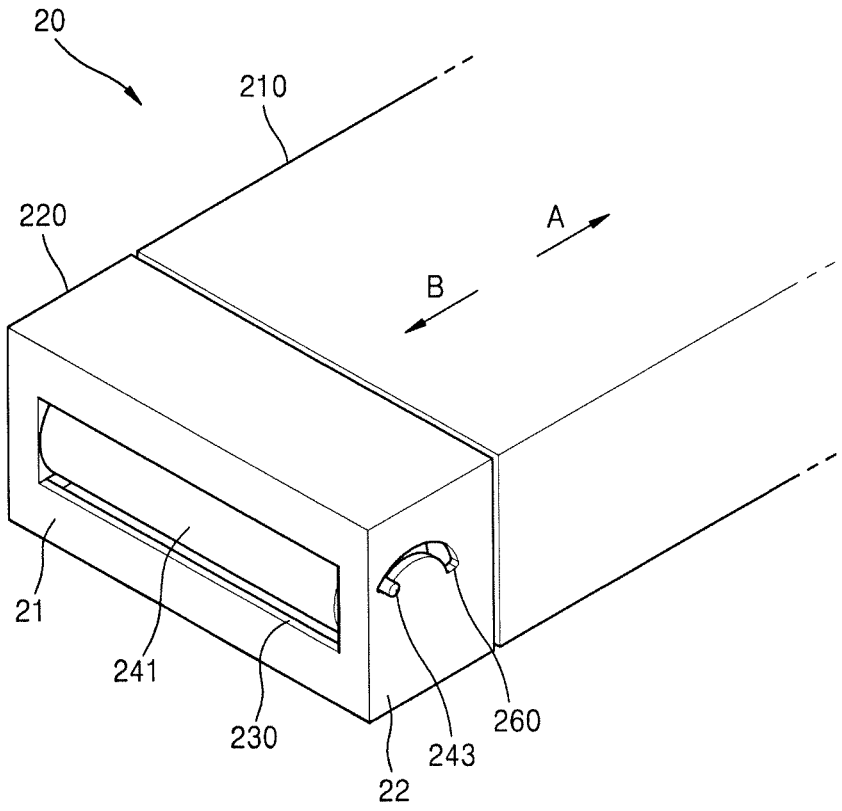
FIG. 4 is a partial perspective view of an example of the toner cartridge shown in FIG. 3, showing a state in which an opening/closing member is located at a first position.
Figure 5:
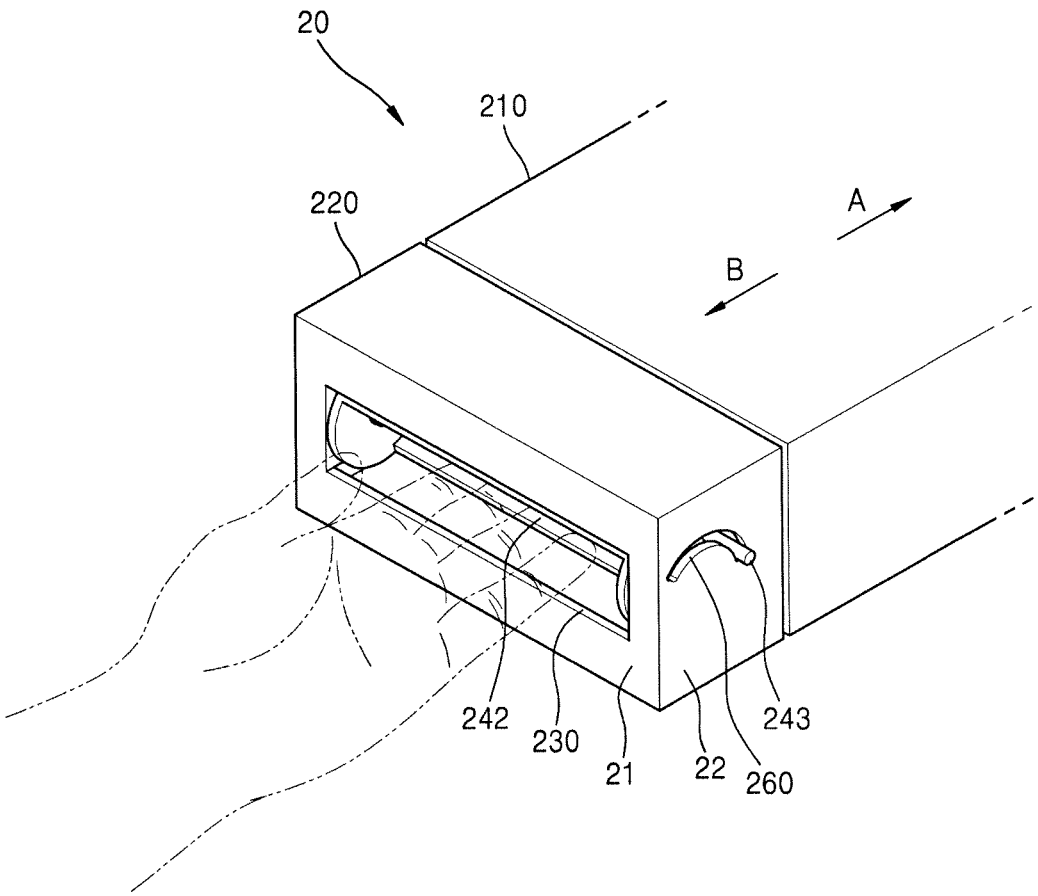
FIG. 5 is a partial perspective view of an example of the toner cartridge shown in FIG. 3, showing a state in which an opening/closing member is located at a second position.

FIG. 3 is a partially exploded perspective view of an example of the toner cartridge 20. FIG. 4 is a partial perspective view of an example of the toner cartridge 20 shown in FIG. 3, showing a state in which an opening/closing member 240 is located at a first position. FIG. 5 is a partial perspective view of an example of the toner cartridge 20 shown in FIG. 3, showing a state in which the opening/closing member 240 is located at a second position.

Referring to FIGS. 3 to 5, the toner cartridge 20 includes a body 210 accommodating toner, a front cover 220 located in front of the body 210 and provided with a first opening 230 for forming a grip portion for pulling the toner cartridge 20 forward, an opening/closing member 240 which is located inside the front cover 220 and is switched to the first position (FIG. 4) closing the first opening 230 and the second position (FIG. 5) opening the first opening 230, and an elastic member 250 for applying an elastic force to the opening/closing member 240 in a direction to be located at the second position.

The front cover 220 is located on the removal direction B side of the body 210. As an example, the first opening 230 may be provided in the front portion 21 of the front cover 220. The first opening 230 may be formed in such a size that a user may put his or her hand into the first opening 230 to pull the toner cartridge 20 in the removal direction B, as shown in FIG. 5.

The opening/closing member 240 is located inside the front cover 220. The opening/closing member 240 may be installed to be rotatable to the first and second positions on the front cover 220. As an example, a pair of support shafts 221 and 222 are provided inside the front cover 220 and holes 244 and 245 into which the support shafts 221 and 222 are inserted may be provided at both ends of the opening/closing member 240, respectively. The opening/closing member 240 may include a blocking portion 241 blocking the first opening 230 when being located at the first position and a concave portion 242 which is aligned with the first opening 230 when being located at the second position and forms the grip portion so as to pull the toner cartridge 20 forward.

The elastic member 250 applies an elastic force to the opening/closing member 240 in a direction to be located at the second position. As an example, the elastic member 250 may be implemented by a torsion coil spring in which a winding portion is inserted into at least one of the support shafts 221 and 222 and two arms extending from the winding portion are supported by the opening/closing member 240 and the front cover 220, respectively.

According to the toner cartridge 20 of the example, in a state in which the toner cartridge 20 is separated from the main body 1, the opening/closing member 240 is maintained in the second position by the elastic force of the elastic member 250. The concave portion 242 is aligned with the first opening 230, and the front portion 21 of the toner cartridge 20 is formed with a grip portion into which a user's hand may be inserted by the first opening 230 and the concave portion 242. The handling convenience of a user with respect to the toner cartridge 20 may be improved in a state in which the toner cartridge 20 is removed from the main body 1. According to the toner cartridge 20 of the example, the first opening 230 forming the grip portion and the opening/closing member 240 do not project to the front portion 21 of the toner cartridge 20. Therefore, damage to the grip portion may be prevented in the process of handling the toner cartridge 20. Packaging design of the toner cartridge 20 is easy, and the risk of damage to the grip portion during transportation may be reduced.

It is necessary that a user cannot arbitrarily remove the toner cartridge 20 in a state where the toner cartridge 20 is mounted on the main body 1. To this end, the opening/closing member 240 is to be switched to the first position. The toner cartridge 20 of the example may have a structure capable of accessing from the outside to switch the opening/closing member 240 from the second position to the first position. As an example, referring to FIG. 3, the front cover 220 may be provided with a second opening 260. The opening/closing member 240 is provided with a switching lever 243 projected from the front cover 220 through the second opening 260 so as to be able to access from the outside the switching lever 243 to switch the opening/closing member 240 located at the second position to the first position. The second opening 260 may be provided on a side portion 22 of the front cover 220. The switching lever 243 may be located eccentrically from the holes 244 and 245 serving as rotation centers of the opening/closing member 240. The switching lever 243 may extend outward from one end or both ends of the opening/closing member 240 and may protrude from the front cover 220 through the second opening 260. One arm of the elastic member 250 in the form of a torsion coil spring is supported by the switching lever 243 and may apply an elastic force to the opening/closing member 240 in a direction to be held at the second position.

With such a configuration, it is possible to switch the opening/closing member 240 from the second position to the first position by accessing the switching lever 243 from the outside and rotating the opening/closing member 240 in a direction opposite to the elastic force of the elastic member 250.

According to the image forming apparatus of the example, the opening/closing member 240 is switched from the second position to the first position by an operation of mounting the toner cartridge 20 to the main body 1. When the toner cartridge 20 is removed from the main body 1, the opening/closing member 240 returns from the first position to the second position by the elastic force of the elastic member 250.

Figure 6:
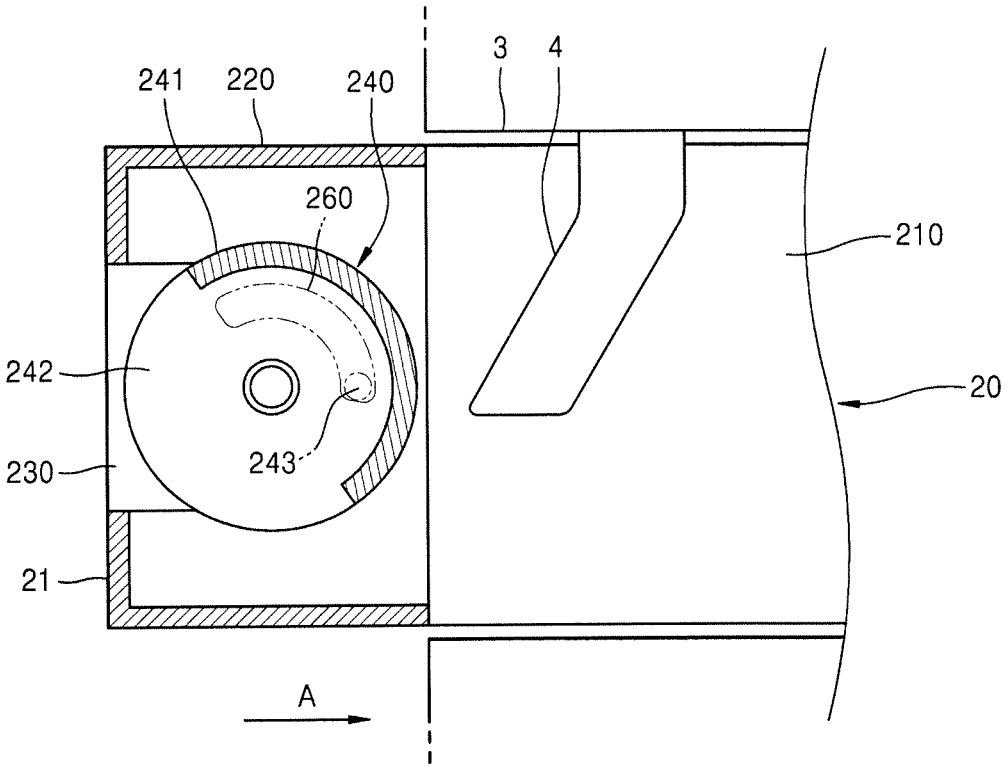
Figure 7:
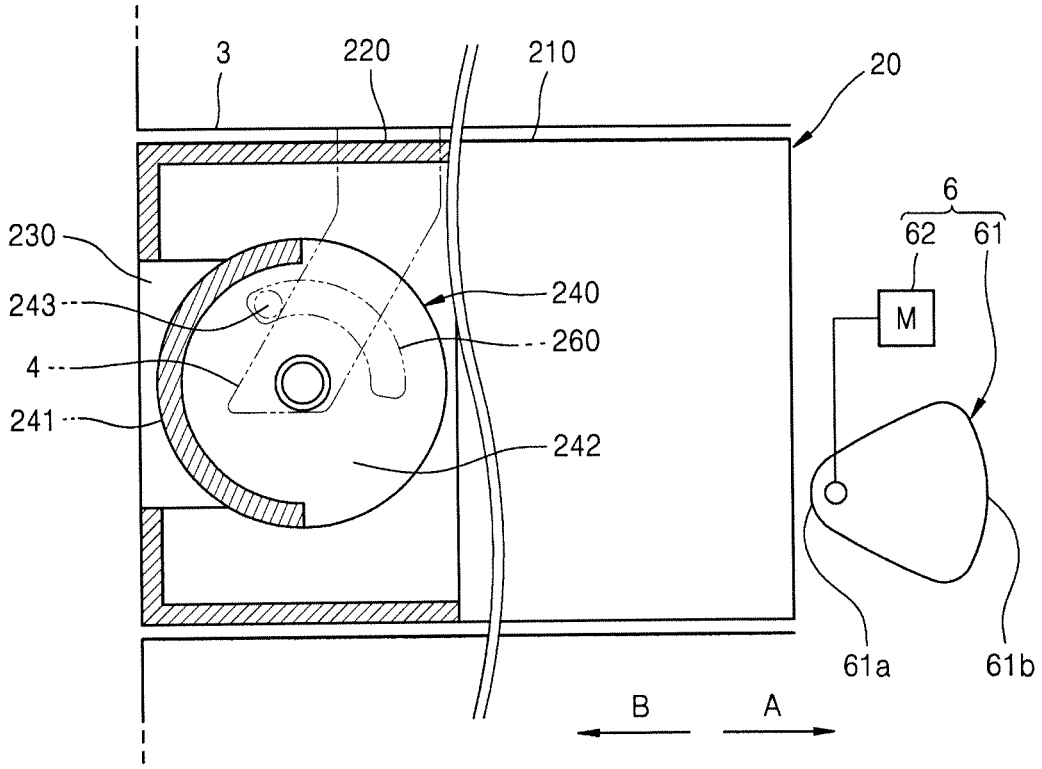
Figure 8:
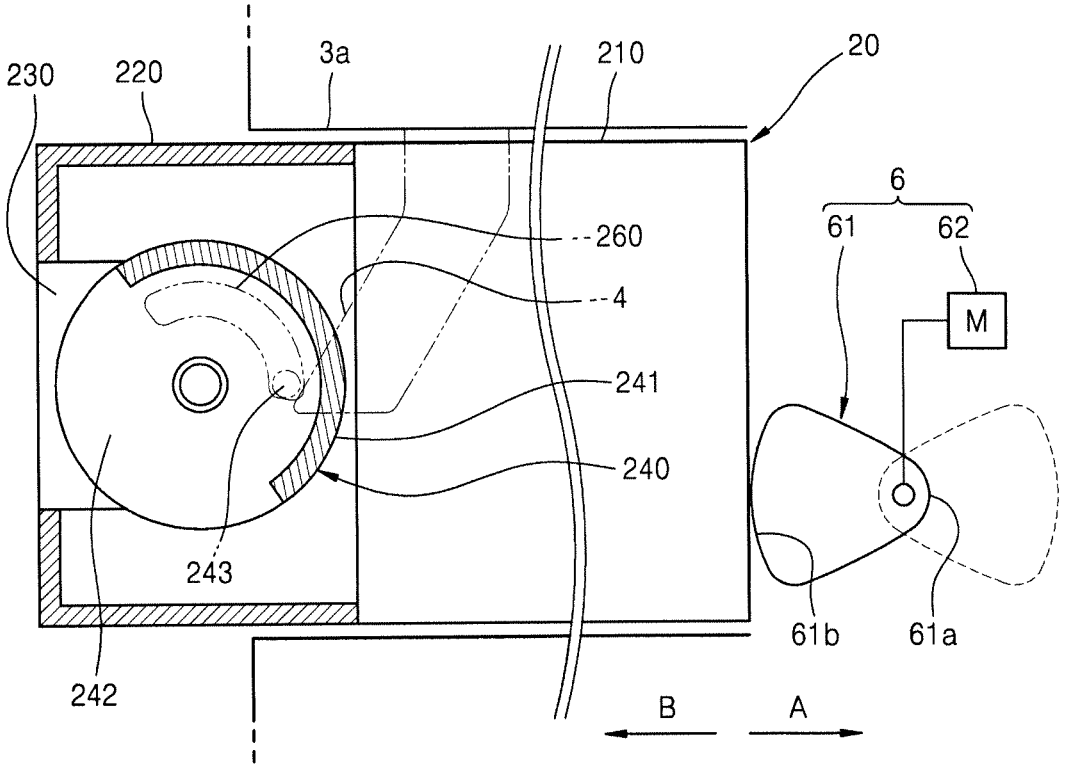
FIG. 8 is a view of a process in which an opening/closing member returns from a first position to a second position when the toner cartridge of the example shown in FIG. 3 is removed from a main body, showing a state in which the toner cartridge is located at a projected position.

FIGS. 6 and 7 are cross-sectional views of an example of a structure for switching the opening/closing member 240 from a second position to a first position by an operation of mounting the toner cartridge 20 to the main body 1. FIG. 6 shows a state before the toner cartridge 20 reaches the mounting position 3*a* (of FIG. 2), and FIG. 7 shows a state in which the toner cartridge 20 reaches the mounting position 3*a* (of FIG. 2). FIG. 8 shows a state in which the opening/closing member 240 returns from the first position to the second position when the toner cartridge 20 is removed from the main body 1. FIG. 8 shows a state in which the toner cartridge 20 is located at the projected position 3*b*.

Referring to FIGS. 6 and 7, the main body 1 is provided with a switching member 4. The switching member 4 switches the opening/closing member 240 from the second position to the first position when the toner cartridge 20 is mounted on the mounting portion 3. The switching lever 243 protrudes from the front cover 220 through the second opening 260 and interferes with the switching member 4 when the toner cartridge 20 is mounted on the mounting portion 3 such that the opening/closing member 240 located at the second position may be switched to the first position. The switching lever 243 of the example protrudes from the side portion 22 of the front cover 220 as described above. The switching member 4 may be provided in the mounting portion 3 so as to interfere with the switching lever 243 protruding from the side portion 22 of the front cover 220.

Referring to FIGS. 7 and 8, the main body 1 may be provided with the removal member 6. The removal member 6 moves the toner cartridge 20 from the mounting position 3*a* (of FIG. 2) to the projected position 3*b* (of FIG. 2). As an example, the removal member 6 may include a cam 61 and a motor 62 for rotating the cam 61. The motor 62 may be a dedicated motor for driving the cam 61. The motor 62 may be a main motor that drives rotational elements of an image forming apparatus. In this case, a clutch (not shown) for selectively transmitting rotational force of the motor 62 to the cam 61 may be interposed between the motor 62 and the cam 61. Although not shown in the drawings, the removal member 6 may be implemented in various forms such as a linear actuator having a stroke that can push the toner cartridge 20 to the projected position 3*b*.

Furthermore, as described above, the removal member 6 may have a structure capable of locking the toner cartridge 20 to the mounting position 3*a*. For example, the removal member 6 may include a locking portion for locking the toner cartridge 20 to the mounting position 3*a* and a removal portion for pushing the toner cartridge 20 from the mounting position 3*a* to the protruding position 3*b*. The locking portion may be implemented by a second hook which is hooked on a first hook provided in the toner cartridge 20 when, for example, the toner cartridge 20 is located at the mounting position 3*a*. The second hook may be rotated, for example, from a hook position hooked on the first hook and a release position released from the first hook. The removal portion may be implemented by a second inclined portion engaging with a first inclined portion provided in the toner cartridge 20 when the toner cartridge 20 is located at the mounting position 3*a*. The second inclined portion may push the first inclined portion while being rotated to push the toner cartridge 20 from the mounting position 3*a* to the projected position 3*b*.

A process of mounting the toner cartridge 20 on the mounting portion 3 of the main body 1 will be described with reference to FIGS. 6 and 7.

A user inserts the body 210 of the toner cartridge 20 into the mounting portion 3. At this time, the user may grip the front cover 220 with one hand and the body 210 with the other hand and may insert the body 210 into the mounting portion 3. A grip portion is formed by the first opening 230 and the concave portion 242 of the opening/closing member 240 because the opening/closing member 240 is held at the second position by an elastic force of the elastic member 250. If necessary, the user may grip a grip portion formed on the front cover 220 with one hand.

The toner cartridge 20 is pushed in the mounting direction A and inserted into the mounting portion 3 as shown in FIG. 6. When the toner cartridge 20 is pushed in the mounting direction A, the toner cartridge 20 reaches the projected position 3*b* and the switching lever 243 contacts the switching member 4. When the toner cartridge 20 is further pushed in the mounting direction A in this state, the opening/closing member 240 is rotated in a direction opposite to the elastic force of the elastic member 250 by interaction of the switching lever 243 and the switching member 4, and the opening/closing member 240 is switched from the second position to the first position.

As shown in FIG. 7, when the toner cartridge 20 reaches the mounting position 3*a*, the opening/closing member 240 reaches the first position. The blocking portion 241 of the opening/closing member 240 aligns with the first opening 230 to block the first opening 230 and the grip portion disappears. Therefore, arbitrary removal of the toner cartridge 20 may be prevented.

A process of removing the toner cartridge 20 from the mounting portion 3 of the main body 1 will be described with reference to FIGS. 7 and 8.

Referring to FIG. 7, the toner cartridge 20 is mounted on the main body 1 and located at the mounting position 3*a*. A bottom dead portion 61*a* of the cam 61 faces the toner cartridge 20. Therefore, the toner cartridge 20 may be held in the mounting position 3*a*. The switching lever 243 is engaged with the switching member 4. Accordingly, the opening/closing member 240 is held in the first position to block the first opening 230.

In order to remove the toner cartridge 20, a control unit drives the motor 62 to rotate the cam 61. The cam 61 pushes the toner cartridge 20 in the removal direction B. The switching lever 243 is moved in a direction away from the switching member 4 as the toner cartridge 20 is pushed in the removal direction B and the opening/closing member 240 is rotated from the first position to the second position by the elastic force of the elastic member 250. The switching lever 243 and the switching member 4 may be kept in contact with each other by the elastic force of the elastic member 250 until the toner cartridge 20 reaches the projected position 3*b*.

When the cam 61 is continuously rotated, the toner cartridge 20 continues to be pushed in the removal direction B. When a top dead portion 61*b* of the cam 61 faces the toner cartridge 20, the toner cartridge 20 is located at the projected position 3*b* as shown in FIG. 8. The opening/closing member 240 reaches the second position. The control unit, in preparation for re-mounting of the toner cartridge 20, may rotate the cam 61 until the bottom dead portion 61*a* faces the toner cartridge 20 as shown by the dashed line in FIG. 8 and may stop the cam 61 at that position.

In this state, the toner cartridge 20 may be pulled in the removal direction B and removed from the main body 1. Since the opening/closing member 240 is located at the second position, the concave portion 242 is aligned with the first opening 230 to form a grip portion. A user may easily remove the toner cartridge 20 from the mounting portion 3 by pulling the toner cartridge 20 in the removal direction B by putting his or her hand into the grip portion as shown in FIG. 5, so that the convenience of removal may be improved.

As described above, according to the toner cartridge 20 and the image forming apparatus employing the toner cartridge 20 of the example, a grip portion is not formed on the front cover 220 when the toner cartridge 20 is located at the mounting position 3*a*, and therefore the toner cartridge 20 may not be pulled in the removal direction B. Therefore, arbitrary removal of the toner cartridge 20 may be prevented. When the toner cartridge 20 is located at the projected position 3*b*, a grip portion is formed on the front cover 220, so that the toner cartridge 20 may be easily removed from the mounting portion 3. In the case of a large-capacity toner cartridge 20, it is inconvenient to grip the whole front shape of the projected toner cartridge 20 by hand. However, according to the example, since a grip portion is formed on the front cover 220, the large-capacity toner cartridge 20 may be easily pulled in the removal direction B.

Figure 9:
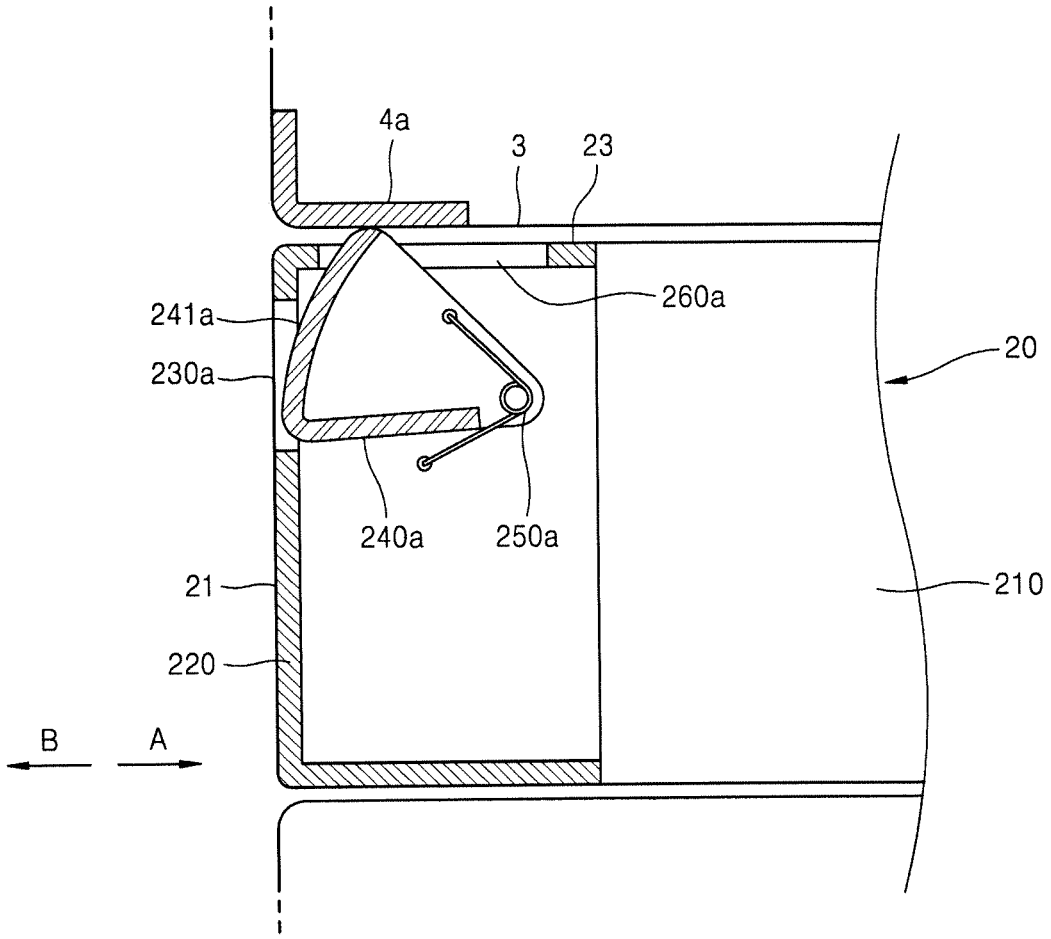
Figure 10:
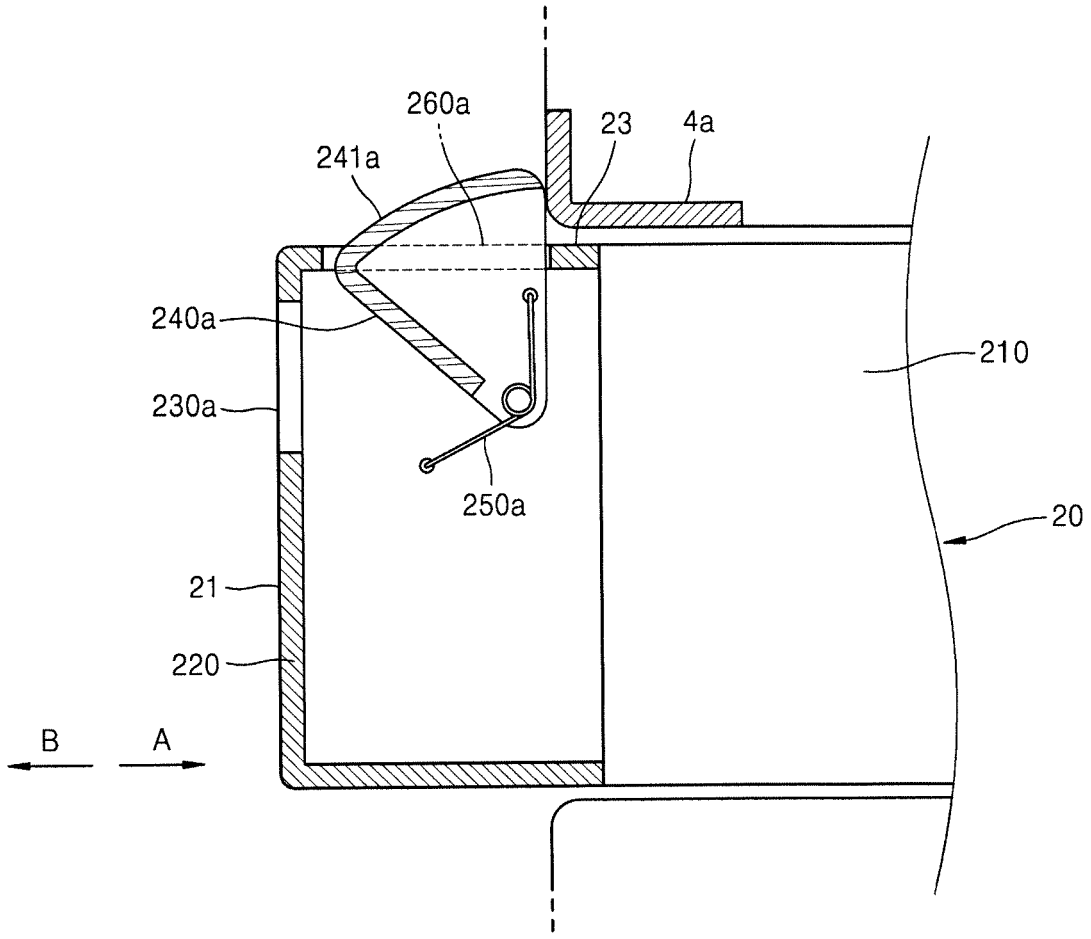

FIGS. 9 and 10 show another example of a structure for mounting/removing the toner cartridge 20 to/from the mounting portion 3 of the main body 1. FIG. 9 shows a state in which the toner cartridge 20 is located at the mounting position 3*a*, and FIG. 10 shows a state in which the toner cartridge 20 is located at the projected position 3*b*.

Referring to FIGS. 9 and 10, an opening/closing member 240*a* is provided so as to be rotatable in a first position (FIG. 9) and a second position (FIG. 10) inside the front cover 220. The opening/closing member 240*a* of the example is different from the opening/closing member 240 shown in FIGS. 3 to 8 in that the opening/closing member 240*a* is exposed to the outside of the front cover 220 when being located at the second position.

The opening/closing member 240*a* has a blocking portion 241*a* which closes the first opening 230*a* when being located at the first position and is to be escaped from a first opening 230*a* in order to form a grip portion to pull the toner cartridge 20 forward, that is, in the removing direction B, when being located at the second position. That is, the blocking portion 241*a* blocks the first opening 230*a* in the first position and opens the first opening 230*a* in the second position. The first opening 230*a* may be provided in the front portion 21. The first opening 230*a* may be located adjacent to an upper surface 23 of the front cover 220.

The blocking portion 241*a* protrudes from the front cover 220 through a second opening 260*a* provided in the front cover 220 such that the opening/closing member 240*a*, which is located at the second position, is switched to the first position by accessing from the outside the blocking portion 241*a*. For example, the second opening 260*a* may be provided on the upper surface 23 of the front cover 220. The main body 1 is provided with a switching member 4*a* for switching the opening/closing member 240*a* from the second position to the first position when the toner cartridge 20 is mounted on the mounting portion 3. The switching member 4*a* is located to face the upper surface 23 of the front cover 220. The blocking portion 241*a* interferes with the switching member 4*a* when the toner cartridge 20 is mounted on the mounting portion 3 to switch the opening/closing member 240*a* located at the second position to the first position.

When the toner cartridge 20 is removed from the main body 1, the opening/closing member 240*a* is located at the second position as shown in FIG. 10. The blocking portion 241*a* is escaped from the first opening 230*a*. Accordingly, the front cover 220 is formed with a grip portion by the first opening 230*a*. The blocking portion 241*a* is exposed to the outside of the front cover 220 through the second opening 260*a*. In this state, when the toner cartridge 20 is inserted into the mounting portion 3 and is pushed in the mounting direction A, the blocking portion 241*a* interferes with the switching member 4*a*. As the toner cartridge 20 is pushed in the mounting direction A, the opening/closing member 240*a* is rotated in a direction opposite to the direction of an elastic force of an elastic member 250*a* to be switched from the second position to the first position. When the toner cartridge 20 reaches the mounting position 3*a*, the opening/closing member 240*a* reaches the first position. The blocking portion 241*a* is aligned with the first opening 230*a* to block the first opening 230*a*. Therefore, when the toner cartridge 20 is located at the mounting position 3*a*, a grip portion is not formed on the front cover 220, and thus the toner cartridge 20 cannot be pulled in the removal direction B so that arbitrary removal of the toner cartridge 20 may be prevented.

A process of removing the toner cartridge 20 from the main body 1 is the same as described above. That is, the cam 61 pushes the toner cartridge 20 to move the same from the mounting position 3*a* to the projected position 3*b*. When the toner cartridge 20 is moved to the projected position 3*b*, the interference between the switching member 4*a* and the blocking portion 241*a* is terminated and the opening/closing member 240*a* is switched to the second position by the elastic force of the elastic member 250*a*. Since an opening/closing member 240*a* is located at the second position, the first opening 230*a* is opened to form a grip portion. A user may easily remove the toner cartridge 20 from the mounting portion 3 by pulling the toner cartridge 20 in the removal direction B by putting his or her hand into the grip portion, so that the convenience of removal may be improved.

Figure 11:
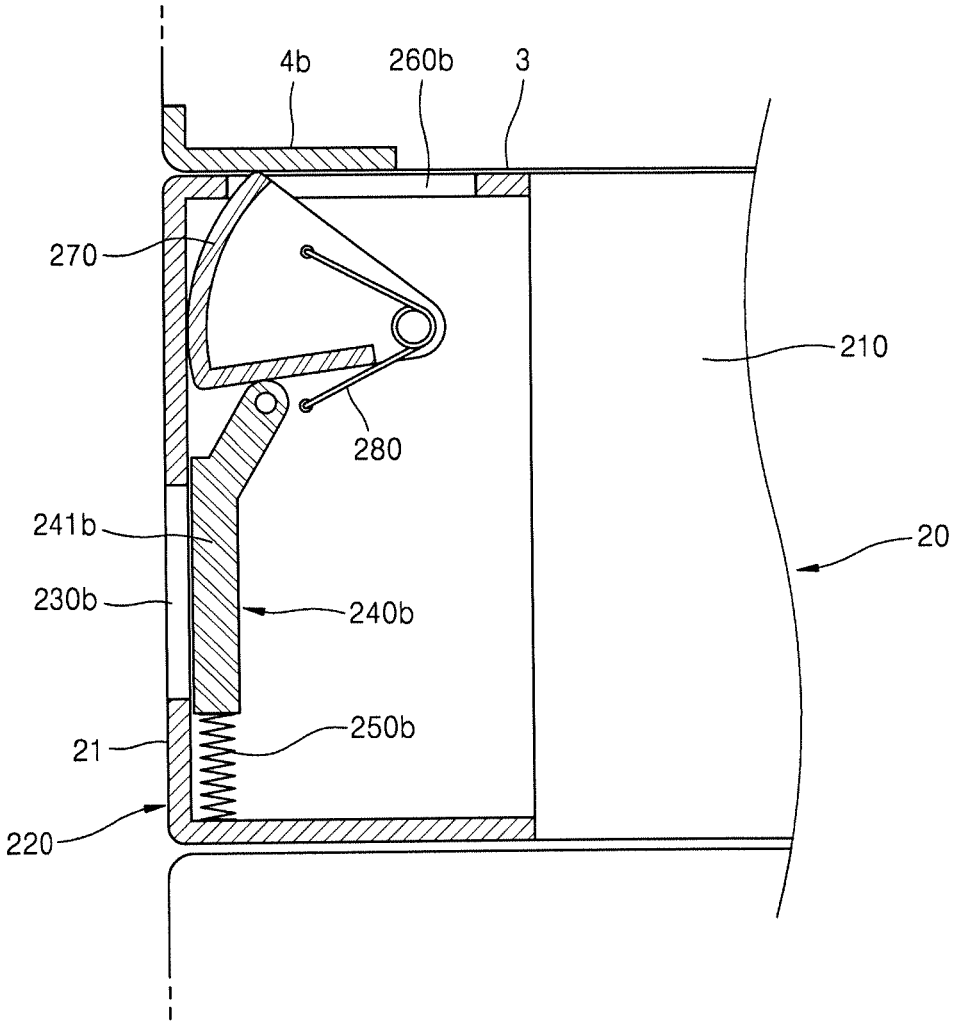
Figure 12:
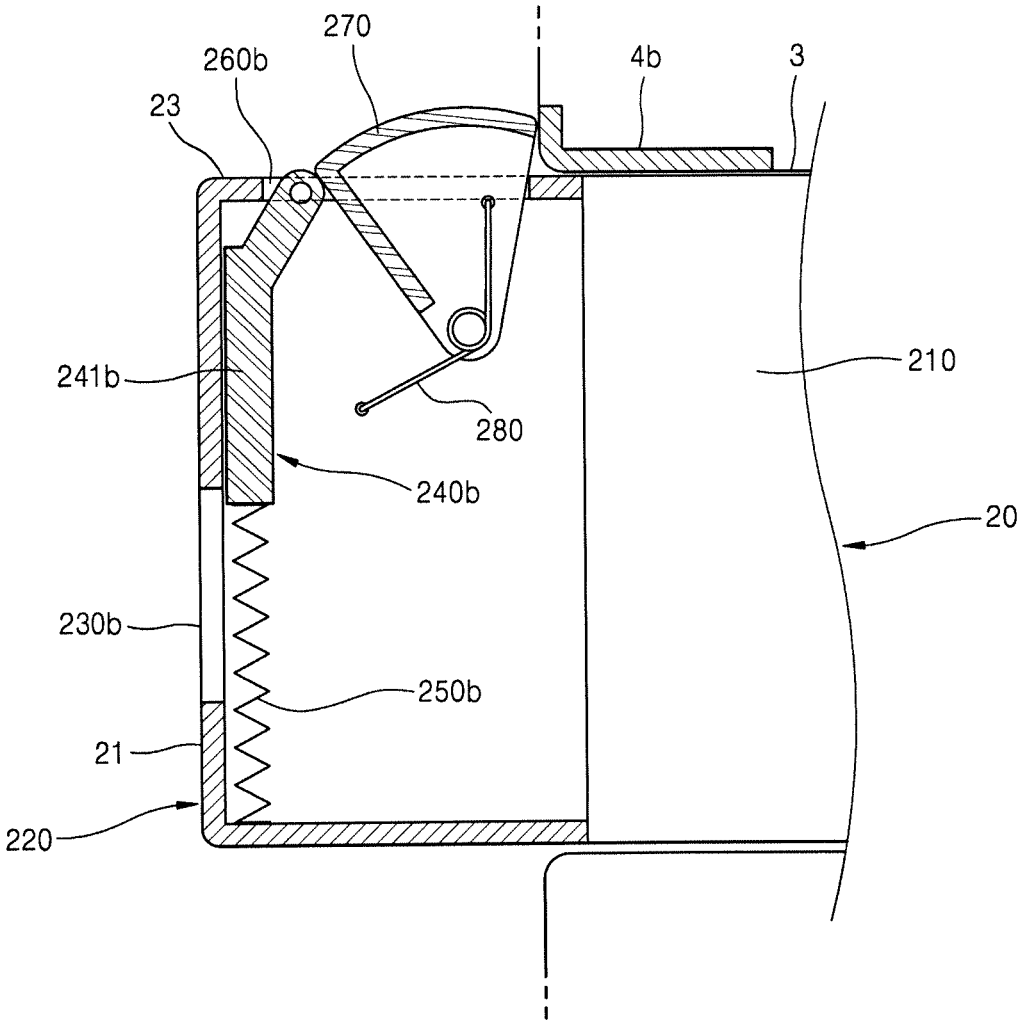

The opening/closing member 240*b* may be slid and moved to the first and second positions in order to form/remove the grip portion. FIGS. 11 and 12 show another example of a structure for mounting/removing the toner cartridge 20 to/from the mounting portion 3 of the main body 1. FIG. 11 shows a state in which the toner cartridge 20 is located at the mounting position 3*a*, and FIG. 12 shows a state in which the toner cartridge 20 is located at the projected position 3*b*.

Referring to FIGS. 11 and 12, the toner cartridge 20 of the example is provided such that the opening/closing member 240*b* may slide in the first position (FIG. 11) and the second position (FIG. 12) inside the front cover 220. Also, the toner cartridge 20 is different from the toner cartridge 20 shown in FIGS. 3 to 8 in that the toner cartridge 20 includes a switching lever 270 exposed to the outside of the front cover 220 when the opening/closing member 240*b* is located at the second position.

The opening/closing member 240*b* has a blocking portion 241*b* which closes a first opening 230*b* when being located at the first position and is to be escaped from the first opening 230*b* in order to form a grip portion to pull the toner cartridge 20 forward, that is, in the removing direction B, when being located at the second position. That is, the blocking portion 241*b* blocks the first opening 230*b* in the first position and opens the first opening 230*a* in the second position. The first opening 230*b* may be provided in the front portion 21.

The switching lever 270 is rotatably installed on the front cover 220. The switching lever 270 protrudes from the front cover 220 through a second opening 260*b* provided in the front cover 220 such that the opening/closing member 240*b*, which is located at the second position, is switched to the first position by accessing from the outside the switching lever 27 when being located at the second position. For example, the second opening 260*b* may be provided on the upper surface 23 of the front cover 220. The switching lever 270 is connected to the opening/closing member 240*b*.

The elastic member 250*b* elastically biases the opening/closing member 240*b* in a direction to be located at the second position. As an example, the elastic member 250*b* may be implemented by a compression coil spring having one end and the other end supported by the front cover 220 and the opening/closing member 240*b*, respectively. The opening/closing member 240*b* elastically contacts the switching lever 270 by an elastic force of the elastic member 250*b*. The switching lever 270 may be elastically biased in a direction to protrude outward through the second opening 260*b* by the elastic force of the elastic member 250*b*. The toner cartridge 20 may further include an elastic member 280 for applying an elastic force to the switching lever 270 such that the switching lever 270 is rotated in the direction to protrude outward through the second opening 260*b*. The elastic member 280 may be implemented by a torsion coil spring in which, for example, a winding portion is provided on a rotating shaft of the switching lever 270 and two arms thereof are supported by the front cover 220 and the switching lever 270, respectively.

The main body 1 is provided with a switching member 4*b* for switching the opening/closing member 240*b* from the second position to the first position when the toner cartridge 20 is mounted on the mounting portion 3. The switching member 4*b* is located to face the upper surface 23 of the front cover 220. The switching lever 270 interferes with the switching member 4*b* when the toner cartridge 20 is mounted on the mounting portion 3 and switches the opening/closing member 240*b* from the second position to the first position.

When the toner cartridge 20 is removed from the main body 1, the opening/closing member 240*b* is located at the second position as shown in FIG. 11. The blocking portion 241*b* is escaped from the first opening 230*b*. Accordingly, the front cover 220 is formed with a grip portion by the first opening 230*b*. The switching lever 270 is exposed to the outside of the front cover 220 through the second opening 260*b*. In this state, when the toner cartridge 20 is inserted into the mounting portion 3 and is pushed in the mounting direction A, the switching lever 270 interferes with the switching member 4*b*. As the toner cartridge 20 is pushed in the mounting direction A, the switching lever 270 is rotated to slide the opening/closing member 240*b* in a direction opposite to the elastic force of the elastic member 250*b* to switch the opening/closing member 240*b* from the second position to the first position. When the toner cartridge 20 reaches the mounting position 3*a*, the opening/closing member 240*b* reaches the first position. The blocking portion 241*a* is aligned with the first opening 230*b* to block the first opening 230*b*. Therefore, when the toner cartridge 20 is located at the mounting position 3*a*, a grip portion is not formed on the front cover 220, and thus the toner cartridge 20 cannot be pulled in the removal direction B so that arbitrary removal of the toner cartridge 20 may be prevented.

A process of removing the toner cartridge 20 from the main body 1 is the same as described above. That is, the cam 61 pushes the toner cartridge 20 to move the same from the mounting position 3*a* to the projected position 3*b*. The interference between the switching member 4*b* and the switching lever 270 is terminated while the toner cartridge 20 is moved to the projected position 3*b* and the switching lever 270 protrudes outward through the second opening 260*b*. The opening/closing member 240*b* is switched to the second position by the elastic force of the elastic member 250*b*. Since an opening/closing member 240*b* is located at the second position, the first opening 230*b* is opened to form a grip portion. A user may easily remove the toner cartridge 20 from the mounting portion 3 by pulling the toner cartridge 20 in the removal direction B by putting his or her hand into the grip portion, so that the convenience of removal may be improved.

It should be understood that the disclosure described herein should be considered in a descriptive sense and not for limitation. Descriptions of features within each example should be considered as available for other similar features in other examples. Therefore, the scope of the disclosure is defined not by the detailed description of the disclosure but by the appended claims.

What is claimed is:

1. A toner cartridge, comprising:

a body to store toner;

a front cover located in front of the body and provided with a first opening to provide a grip portion to pull the toner cartridge in a forward direction;

an opening/closing member located inside the front cover and switchable between a first position at which the first opening is closed and a second position at which the first opening is opened; and an elastic member to apply an elastic force to the opening/closing member in a direction to restore the opening/closing member to the second position.

2. The toner cartridge of claim 1, wherein the opening/closing member is rotatable between the first position and the second position.

3. The toner cartridge of claim 2, wherein the opening/closing member includes:

a blocking portion to block the first opening when the opening/closing member is at the first position, and a concave portion, aligned with the first opening when the opening/closing member is at the second position, and which forms at least a portion of the grip portion to pull the toner cartridge in the forward direction.

4. The toner cartridge of claim 3, wherein the front cover is provided with a second opening, the opening/closing member includes a switching lever which protrudes from the front cover through the second opening, and the switching lever is accessible from outside the front cover to switch the opening/closing member between the first position and the second position.

5. The toner cartridge of claim 2, wherein the opening/closing member includes a blocking portion to close the first opening when the opening/closing member is at the first position and to open the first opening to form at least a portion of the grip portion when the opening/closing member is at the second position.

6. The toner cartridge of claim 5, wherein the front cover is provided with a second opening, when the opening/closing member is at the second position, the blocking portion protrudes from the front cover through the second opening, and when the opening/closing member is at the second position and the blocking portion protrudes from the front cover through the second opening, the blocking portion is to receive a force to switch the opening/closing member from the second position to the first position.

7. The toner cartridge of claim 1, wherein the opening/closing member is slidable between the first position and the second position.

8. The toner cartridge of claim 7, wherein the opening/closing member includes a blocking portion to close the first opening when the opening/closing member is at the first position and to open the first opening to form at least a portion of the grip portion when the opening/closing member is at the second position.

9. The toner cartridge of claim 8, wherein the front cover is provided with a second opening, and the toner cartridge further comprises:

a switching lever to protrude from the front cover through the second opening when the opening/closing member is at the second position, and when the opening/closing member is at the second position and the switching lever protrudes from the front cover through the second opening, the switching lever is to receive a force to switch the opening/closing member from the second position to the first position.

10. An image forming apparatus, comprising:

a main body having a mounting portion;

the toner cartridge according to claim 1, slidable in a rearward direction to mount the toner cartridge into the mounting portion and slidable in the forward direction to remove the toner cartridge from the mounting portion; and a switching member, provided in the main body, to switch the opening/closing member from the second position to the first position when the toner cartridge is mounted into the mounting portion.

11. The image forming apparatus of claim 10, further comprising:

a removal member, provided in the main body, to push the toner cartridge forward to move the toner cartridge from a mounting position where the toner cartridge is provided in the mounting portion to a projected position where the front cover of the toner cartridge projects from the mounting portion, and the elastic member is to apply the elastic force to the opening/closing member to restore the opening/closing member from the first position to the second position when the toner cartridge is pushed from the mounting position to the projected position by the removal member.

12. The image forming apparatus of claim 11, wherein the opening/closing member is rotatable between the first position and the second position, and the opening/closing member includes:

a blocking portion to block the first opening when the opening/closing member is at the first position, and a concave portion, aligned with the first opening when the opening/closing member is at the second position, and which forms a portion of the grip portion to pull the toner cartridge in the forward direction.

13. The image forming apparatus of claim 12, wherein the front cover is provided with a second opening, and the opening/closing member includes a switching lever which protrudes from the front cover through the second opening when the opening/closing member is at the second position, and when the toner cartridge is mounted into the mounting portion and the opening/closing member is at the second position, the switching lever is to interfere with the switching member such that the opening/closing member is switched from the second position to the first position.

14. The image forming apparatus of claim 10, wherein the opening/closing member includes a blocking portion to close the first opening when the opening/closing member is at the first position and to open the first opening to form at least a portion of the grip portion when the opening/closing member is at the second position, the front cover is provided with a second opening, when the opening/closing member is at the second position, the blocking portion protrudes from the front cover through the second opening, and when the toner cartridge is mounted into the mounting portion and the opening/closing member is at the second position, the blocking portion is to interfere with the switching member such that the opening/closing member is switched from the second position to the first position.

15. The image forming apparatus of claim 10, wherein the opening/closing member includes a blocking portion to close the first opening when the opening/closing member is at the first position and to open the first opening to form at least a portion of the grip portion when the opening/closing member is at the second position, the opening/closing member is slidable between the first position and the second position, the front cover is provided with a second opening and a switching lever that, when the opening/closing member is at the second position, protrudes from the front cover through the second opening, and when the toner cartridge is mounted into the mounting portion and the opening/closing member is at the second position, the switching lever is to interfere with the switching member such that the opening/closing member is switched from the second position to the first position.

* * * * *